United States Patent [19]

McBrayer et al.

[11] 4,335,783

[45] Jun. 22, 1982

[54] METHOD FOR IMPROVING THERMAL SHOCK RESISTANCE OF HONEYCOMBED STRUCTURES FORMED FROM JOINED CELLULAR SEGMENTS

[75] Inventors: Robert D. McBrayer, Painted Post; Vimal K. Pujari, Corning, both of N.Y.

[73] Assignee: Corning Glass Works, Corning, N.Y.

[21] Appl. No.: 205,775

[22] Filed: Nov. 10, 1980

[51] Int. Cl.[3] ..... F28D 19/00

[52] U.S. Cl. ..... 165/8; 165/10; 156/291; 156/304.1; 156/308.4; 428/116; 428/194

[58] Field of Search ..... 165/8, 10; 428/116 X, 428/118, 194 X, 195, 73, 65; 156/290, 291 X, 197, 304.1 X, 308.4 X

[56] References Cited

U.S. PATENT DOCUMENTS

| | | | |
|---|---|---|---|
| 3,582,301 | 6/1971 | Andrysiab et al. | 165/10 |
| 3,887,741 | 6/1975 | Dwyer | 428/116 |
| 3,893,283 | 9/1976 | Bagley | 428/116 |
| 3,918,517 | 11/1975 | Silverstone et al. | 165/10 |
| 4,127,691 | 6/1977 | Frost | 428/116 |

FOREIGN PATENT DOCUMENTS

| | | | |
|---|---|---|---|
| 2022071A | 12/1979 | United Kingdom . | |
| 2031571 | 4/1980 | United Kingdom | 165/10 |

*Primary Examiner*—Albert W. Davis
*Attorney, Agent, or Firm*—Richard N. Wardell

[57] ABSTRACT

A method of improving the thermal shock resistance of a honeycombed structure through which fluids flow and formed by joining a plurality of cellular segments to one another along their peripheral walls, by providing discontinuities through the joints formed between the adjoining segments in the direction of the fluid flow through the structure so as to lessen temperature differences occurring in the joint area, to provide the structure with greater flexibility and to act as crack arrestors lessening the transmission of stresses between adjoining segments and through the joints. In two preferred embodiments, the invention is practiced in forming a heat recovery wheel by joining a plurality of cellular segments to one another with cement which is striped to the segments so as to form a plurality of hollow, straight walled, channels extending essentially axially through some or all of the joint areas of the resulting wheel.

19 Claims, 6 Drawing Figures

METHOD FOR IMPROVING THERMAL SHOCK RESISTANCE OF HONEYCOMBED STRUCTURES FORMED FROM JOINED CELLULAR SEGMENTS

BACKGROUND OF THE INVENTION

This invention relates to a method of forming honeycombed structures from joined cellular segments themselves formed from a ceramic based or other suitable material so as to improve their thermal shock resistance, and in particular to a method of constructing a heat recovery wheel having improved thermal shock resistance and the wheel produced thereby.

Honeycombed structures are used in a variety of applications such as catalytic reactors and heat recovery wheels for conditioning flowing fluids, primarily gases. Such structures consist primarily or entirely of a matrix having a plurality of apertures or hollow, open-ended cells which permit the passage of gases through the structure. Because these structures are subjected to relatively severe thermal shock conditions they are commonly fabricated from ceramic or glass-ceramic materials having very low coefficients of thermal expansion. Other materials (e.g. glass, sintered metal, cermet or other ceramic based materials) could be employed as desired if they were suitable (e.g. sufficient strength, chemical resistance, refractoriness, thermal shock resistance, etc.) with the service conditions encountered.

Heat recovery wheels (also called rotary heat exchangers) are devices for transferring heat from hot gases, generally combustion exhaust, to heat relatively cooler gases, often air to be preheated for combustion. Heat exchange is accomplished by rotating the wheel through simultaneous flows of relatively hot and cold gases. The portion of the wheel's matrix exposed to the gas flows alternately absorbs heat from the hot gas and and releases it to the cold gas. Matrices can be produced by the processes of extrusion or "wrapping" (the building up of corrugated layers). The larger size ceramic wheels needed for efficient industrial heat recovery uses (typically two or more feet in diameter) are most commonly formed by cementing together smaller cellular segments made by the wrap process.

Corning Glass Works has for some time manufactured heat recovery wheels constructed from cemented cellular segments of wrapped glass-ceramic material of a type disclosed in U.S. Pat. No. 3,600,204, having a very low coefficient of thermal expansion (less than $10\times10^{-7}$/°C. over the range 0°–1000° C.). This material however is not suitable for all applications because of its susceptibility to attack by hydrogen and sodium ions present in certain exhaust gases. It was discovered in attempting to construct wheels from cordierite materials having a greater resistance to such attack but also a somewhat greater coefficient of thermal expansion (on the order of 20 to $30\times10^{-7}$/°C.) that premature cracking consistently occurred in the cement joint areas between the cellular segments, which would continue to propagate until wheel failure occurred.

The previously employed method of constructing such wheels consisted of joining several cellular segments with cement which was applied continuously between the joined cellular segments so as to form solid cement joints across the annular faces of the resulting wheel. This method is now known to be the cause of higher thermally induced stresses in the cement joint areas and adjoining matrix. Thermally induced stresses in these wheels are directly proportional to the magnitudes of both temperature differences and the coefficients of thermal expansion of the materials used. The blockage of gas flow resulting from the continuous cement joints created significant thermal differences across the annular faces and through the axial thickness of the wheel in the joint areas. These stresses were generally not so great as to cause regular cracking under prevalent operating conditions in wheels fabricated from the more stable glass-ceramic material. Also, the old continuous joint cementing method created a rather rigid wheel. Since the level of thermal stresses is also directly proportional to effective modulus of elasticity, this resulted in a more highly stressed wheel. Applicants believe these relationships were not heretofore perceived.

SUMMARY OF THE INVENTION

It is an object of this invention to provide a method for fabricating a honeycomb structure from joined cellular segments so as to prevent excessive temperature differences from developing in the joint areas created between the cellular segments.

It is another object of the invention to provide a method for fabricating a honeycomb structure from joined cellular segments which improves the structure's resistance to thermal shock by lowering its effective moduli of elasticity.

It is another object of the invention to provide an improved cement joint for honeycomb structures fabricated from cellular segments which acts as a crack arrestor in the joint area.

It is a further object of the invention to provide a method for fabricating heat recovery wheels from cellular segments formed of ceramic or other sinterable material having a coefficient of thermal expansion of approximately $20\times10^{-7}$/°C. or greater over the range 0° to 1000° Centigrade and the heat recovery wheel produced thereby.

According to the invention, a honeycomb structure, which is intended to allow the passage of hot fluids therethrough such as a heat recovery wheel, and fabricated by joining together cellular segments by cementing, fusing or other similar suitable means, is improved by providing a plurality of discontinuities in joints formed between adjoining cellular segments which extend through the resulting structure and are oriented similarly to the direction of the open cells extending through the cellular segments whereby fluid is allowed to flow through the joint areas reducing temperature differences. When the invention is used to fabricate a heat recovery wheel, cement is typically used to join cellular segments formed by conventional extrusion or wrapping processes and is applied discontinuously, preferably in stripes, so as to form a plurality of individual cement segments separated by discontinuities in the form of parallel walled channels extending between the outer annular faces of the wheel.

It has been discovered that applying the cement discontinuously so as to form discontinuities extending axially through the resulting wheel, through which the hot and cold gases can flow, reduces the axial temperature differences during heat recovery operations and therefore the thermally induced stresses occurring both across the annular faces and through the axial thickness of the wheel in the cement joint areas. Furthermore, it has been found that the use of the discontinuous joining method improves the ability of the wheel to withstand stresses caused by very rapid heating (thermal shock). It is believed that providing discontinuous cement joints decreases the effective moduli of elasticity of the resulting wheel as compared to one constructed with the old, continuous cement joint method. Since the stresses induced in the wheel by thermal shock are also directly proportional to the wheel's effective moduli of elasticity, this results in a wheel having improved thermal shock resistance. Lastly it has been discovered that the discontinuous cement joints act as crack arrestors, i.e., cracks which form in a cellular segment or in one cement joint are unable to propagate through the discontinuities to adjacent segments or joint areas.

DETAILED DESCRIPTION OF THE INVENTION

Figure 1:
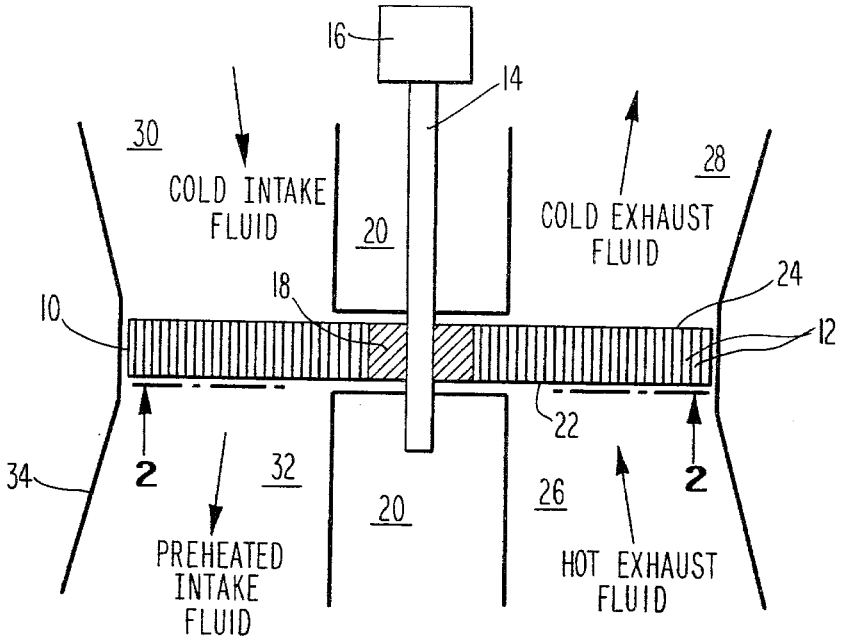
FIG. 1 is a diagrammatic view of a counterflow heat exchanger system utilizing a heat recovery wheel as would be assembled in accordance with the teachings of the invention.

FIG. 1 depicts a typical counterflow heat exchanger system using a rotary heat recovery wheel 10 made in accordance with the teachings of this invention. The wheel 10 has been cross-sectioned in FIG. 1 to expose an annular honeycomb matrix consisting of a plurality of substantially parallel, open-ended, hollow cells 12 formed by thin webs off rigid material running axially from a first annular face 22 to a second annular face 24 through the thickness of the wheel 10.

Typically a shaft assembly 14 of steel or similar material is provided to support the wheel 10 through its central axis. In the system depicted, the shaft assembly 14 is also used to rotate the wheel at a regular rate by a motor 16. The mechanical linkages between the shaft assembly 14 and motor 16 and between the shaft assembly 14 and the wheel 10 have been omitted from the FIG. 1. Means of coupling the wheel to a shaft are disclosed in U.s. Pat. No. 3,978,914 to Phillips and in copending application Ser. Nos. 205,779 and 205,780 filed Nov. 10, 1980, the latter two being assigned to the assignee of this application and all being incorporated by reference herein. A central cylindrical hub 18 of solid material is typically provided integrally at the center of the wheel 10 to insulate the shaft assembly 14 from overheating and to support the greater mechanical stresses present in that area. Alternatively, the central hub 18 may be a honeycombed matrix formed more densely that the remainder of the matrix or even dispensed with if the wheel is sufficiently small or the material used to form it sufficiently strong to withstand the maximum stresses to which the central area of the wheel is exposed during operation. Also, alternatively, the wheel may be supported and driven at its circumference and the central hub 18 and shaft 14 dispensed with.

The function of the wheel 10 is to transfer thermal energy between gases having differing temperatures which flow through opposite halves of the wheel 10. Seal columns 20 are positioned juxtaposed the annular faces 22 and 24, extending away therefrom and separating the hot and cold gases flowing through the wheel 10. A seal column embodiment suggested for use in a counterflow heat exchanger system of the type being described is disclosed in a companion copending application Ser. No. 205,744, filed Nov. 10, 1980, assigned to the assignee of this application, which is hereby incorporated by reference. Outer walls 34 surround the wheel 10 and seal columns 20 forming chambers 26, 28, 30 and 32 on either side of the wheel 10. The first chamber 26 funnels hot gas to a first annular face 22 of the wheel 10. In typical applications, the hot gas consists of combustion exhaust gases. The hot "exhaust" gas is forced by suitable means (not depicted) such as gravity, convection, a pump, or a fan, to flow through the cells 12 in the wheel 10 and in the process gives up its heat to the material forming the walls of the cells 12. The then cooled exhaust gas passes through the second annular face 24 of the wheel 10 into a second chamber 28 which in turn leads to a suitable means of disposal (not depicted). In time, the portion of the wheel 10 to the right of the shaft 14 (as viewed in FIG. 1), having been warmed by the hot exhaust gas, is rotated by the shaft 14 and motor 16 to the left side of the hub 18 and is exposed to a cold gas being channeled into a third chamber 30. Typically the cold gas is intake air to be preheated for combustion. The cold intake gas is forced by appropriate means (again not depicted) through the second annular face 24, cells 12 and first annular face 22 of the wheel 10 into a fourth chamber 32 and, in the process, absorbs the heat being held in the thin ceramic walls forming the cells 12 on the left side of the wheel 10 (as viewed in FIG. 1). The now warmed intake gas in the fourth chamber 32 is conducted away from the wheel 10 by suitable means (not depicted) for use. The hot exhaust and cold intake gases are run in opposite directions through the wheel 10 to maximize the thermal efficiency of the system. This results in "hot" and "cold" faces (the first annular face 22 and second annular face 24, respectively, in the system depicted in FIG. 1) in the wheel, the former operating at a higher average temperature than the latter.

Figure 2:
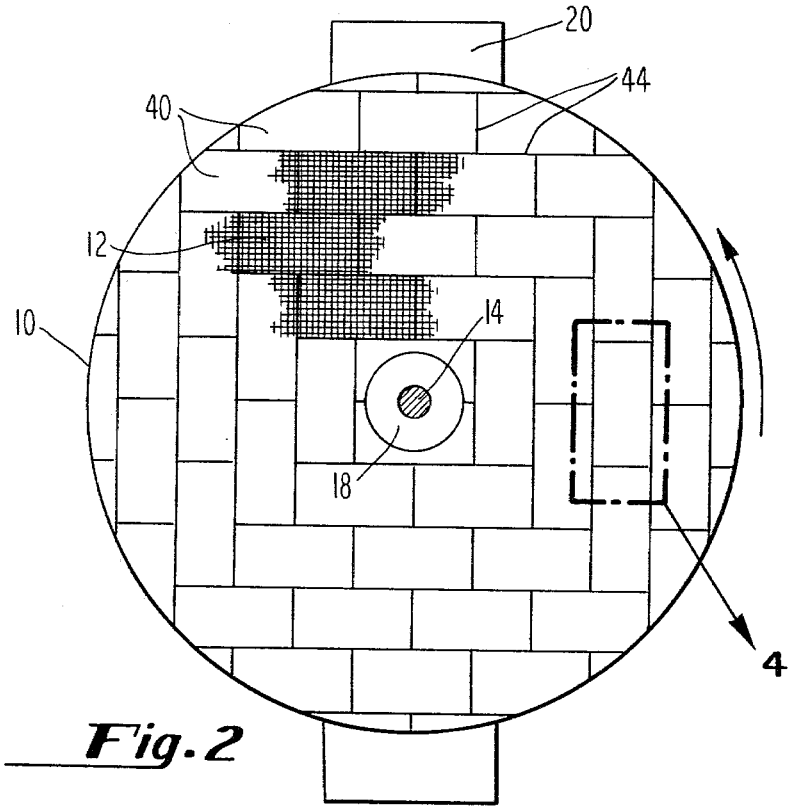
FIG. 2 is a diagrammatic view along line 2—2 of FIG. 1 depicting a first heat recovery wheel made by cementing together extruded cellular segments in accordance with the teachings of the invention.

Referring now to FIG. 2, there is depicted the first annular "hot" face 22 of a heat recovery wheel 10 used in the system depicted in FIG. 1 which has been fabricated in accordance with the teachings of this invention. The wheel 10 in FIG. 2 consists of a central hub 18 and a plurality of cellular segments in the form of relatively small blocks 40. As is partially depicted in magnification, each block 40 comprises a plurality of hollow, open-ended cells 12 typically formed from thin intersecting webs of a ceramic based material (see also FIG. 3). The cells 12 extend between, and their open ends form opposing honeycombed surfaces on two sides of each block 40. Peripheral side walls (see FIG. 3) formed by the outermost layer of thin webs forming the outermost layer of cells 12 or an essentially solid skin constitute the remaining outer surfaces of each block 40. The blocks 40 are positioned in a regular fashion and are joined to one another and to the outer cylindrical surface of the central hub 18 along their peripheral side walls. A joint 44 exists between adjoining blocks 40. Each block 40 extends through the axial thickness of the wheel 10 and is arranged so that its honeycombed faces form a portion of the two open annular faces 22 and 24 of the resulting wheel 10. Typically cement is used to join the blocks 40 and central hub 18 to one another, although other methods such as fusing may be used depending upon the materials selected.

The cells 12 in each block can be formed in a variety of geometries such as are disclosed in, among others, U.S. Pat. Nos. 4,127,691 to Frost and 4,135,018 to Bonin et al. A companion copending application Ser. No. 205,777 filed Nov. 10, 1980, assigned to the assignee of this application, also discloses two preferred arrangements of call geometries and cellular segments to form heat recovery wheel having square cells. The aforesaid patents and application are incorporated by reference herein.

Figure 3:
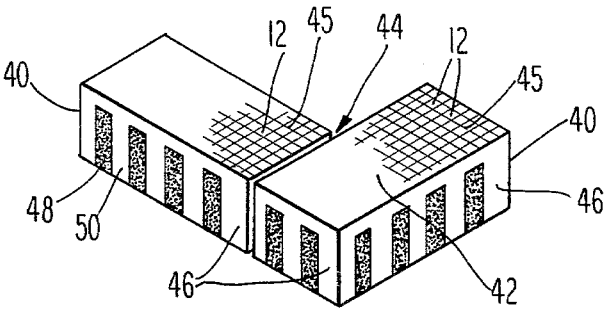
FIG. 3 is a view depicting the manner in which cement is applied to the individual cellular segments comprising the wheel in FIG. 2.

FIG. 3 depicts two typical blocks 40 from the wheel 10 depicted in FIGS. 1 and 2 joined in accordance with the teachings of the invention. As can better be seen in this figure, each block 40 consists of a matrix of thin webs 45 (partially depicted in magnification) which extend through each block 40 to form the plurality of open-ended hollow cells 12 extending between opposing honeycombed surfaces 42 on the top and bottom of the blocks 40 (as viewed in FIG. 3). Peripheral side walls 46 form the remaining outer surfaces of each block 40. A joint 44 exists between the adjoining blocks 40.

According to the invention discontinuities 50 are created in the joints 44 to allow passage of gases in an essentially axial direction through the joints 44. In this embodiment, cement is used to join the blocks 40 and is applied to the peripheral faces 46 of the adjoining blocks so as to create a plurality of individual cement segments 48 in each joint 44, separated by discontinuities 50 which extend between the annular faces 22 and 24 of the resulting wheel 10. Typically the materials used to form the hub 18 and blocks 40 and the cement used to join them to one another have identical or very similar thermal expansion characteristics over the range of operating temperatures of the resulting wheel 10 so as to minimize the generation of stresses from uneven expansion. Ideally the number of cells per unit area of the opposing honeycombed surfaces of the surrounding blocks 40 should be duplicated in the cement joints to minimize the temperature differences occurring, but this cannot be accomplished with existing manufacturing techniques and apparatus. It is therefore preferred that the cement be applied to the blocks 40 by any method suitable for use with the cement selected so that a series of evenly spaced, evenly sized cement stripes 48 are formed in the finished wheel with discontinuities 50 therebetween. The discontinuities 50 are also preferably aligned approximately parallel with the central longitudinal axes of the surrounding cells 12 and thus extend essentially axially through the wheel 10. Divergence from the preferred method described will still provide improved performance in the resulting structure, so long as the discontinuities 50 provided extend through the joints 44 from one outer surface of the resulting structure to the opposing outer surface so as to allow the passage of gases therethrough.

A solid joint of cement is formed between the hub 18 and the blocks 40 adjoining it as increased strength is needed in that area and little if any fluid flow occurs axially through the wheel 10 in that region due to the presence of the seal columns 20.

Where the resulting honeycomb structure being fabricated is to be used with opposing "hot" and "cold" outer surfaces as would be the heat recovery wheel being described, it is further preferred that the cement used to bond the blocks 40 to one another (but not that used to bond the blocks 40 to the hub 18) be stopped approximately one-half inch (1.27 cm) short of the resulting hot surface of the structure (the first annular face 22 of the wheel 10 in the system depicted in FIG. 1) as is depicted in FIG. 3. This is the subject of a copending application Ser. No. 205,776 filed Nov. 10, 1980, assigned to the assignee of this application, which is incorporated by reference herein.

Figure 4:
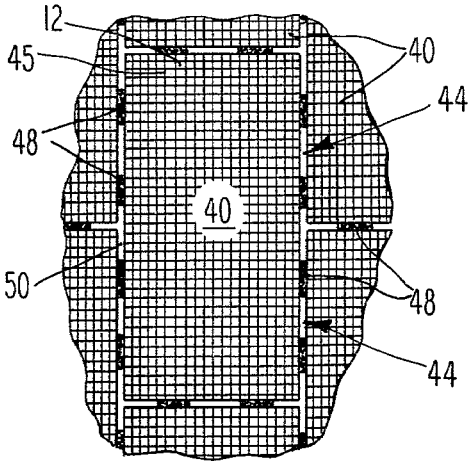
FIG. 4 is a blown-up view of area 4 of FIG. 2 disclosing the discontinuities in the cement joints around one cellular segment resulting from the cement application depicted in FIG. 3.

FIG. 4 is an exploded view of the area 4 of the wheel 10 in FIG. 2 which depicts a portion of the first annular face 22 of the wheel 10 and the arrangement of cement segments 48 and discontinuities 50 in the joints 44 resulting from the cement application depicted in FIG. 3 and described above. The cement segments 48 should be of sufficient length along the adjoining peripheral faces 46 and of sufficient thickness between the adjoining peripheral faces 46 to assure the mechanical integrity of the resulting wheel but no wider or thicker than necessary so as to minimize the temperature differences within and around the cement segments 48 during operation and the elastic moduli of the resulting wheel.

Tests of this first embodiment of the invention were conducted on experimental 28-inch (71-cm) diameter heat recovery wheels. The blocks 40 and hub 18 were extruded from a cordierite material in which 2.5% manganese oxide by weight has been substituted for a comparable amount of magnesium oxide to enhance the material's resistance to attack by $NaNO_3$ and $H_2SO_4$ present in certain exhaust gases. This cordierite composition has a coefficient of thermal expansion of approximately $18\times10^{-7}/°C.$ over the range 0°-1000° C. and is the subject of a copending application Ser. No. 165,611 filed July 3, 1980 by Irwin M. Lachman, which is assigned to the assignee of this application and incorporated by reference herein. Once fired, extruded honeycombed logs were cut into blocks slightly thicker than the resulting wheel, ground to a uniform size (approximately 5.16 in. by 2.58 in. or 13.1 cm by 6.55 cm) and joined with one another and with a central hub having a four inch (10.2 cm) outer diameter and one and one-half inch (3.82 cm) inner diameter using a glass-ceramic foaming cement produced in accordance with U.S. Pat. No. 3,634,111 and comprising by weight 4.0% ZnO, 8.0% CaO, 3.4% SiC and 84.6% glass frit of composition 1 set forth in Table I of that patent. The cement has a thermal expansion rate which suitably follows that of the cordierite material over the range 0° to 1000° C. The amount was applied in stripes between the blocks by an air powered caulking gun. Two stripe sizes were tested: approximately three-quarter inch (1.9 cm) wide (final foamed dimension) and evenly spaced, four to the long (5.16 inch or 13.1 cm) and two to the short (2.58 inch or 6.55 cm) peripheral side walls of each block; and approximately 1.5 inches (3.8 cm) wide (final foamed dimension) and evenly spaced, two to the long side and one to the short peripheral side walls. The spacing between adjoining stripes on the same face of a block 40 was approximately twice that between each outermost stripe and adjoining block edge so that the resulting stripes were approximately evenly spaced through the joints 44 throughout the resulting wheel as can be seen in FIG. 4. After cementing, the innermost blocks were bound, covered with wax for protection and cored by conventional means to accept the hub which was cemented into place with a solid layer of cement. The remaining blocks were also cemented into place according to the preferred method previously described. Each wheel was placed on a sand surface and fired to foam and sinter the cement between and to the adjoining wheel parts. Refractory bricks were positioned against the outer circumferential blocks during firing to retard the expansion of the cement while foaming. The thickness of the cement between the adjoining peripheral faces of the blocks was between approximately one-sixteenth to one-eighth of an inch (1.6 and 3.2 mm) after the firing and foaming. After firing, the wheels were ground to final size and 2.8 inch (7.1 cm) thickness by conventional methods.

Test wheels were run through the following heating cycles in sequence: heat to 1500° F. (approximately 820° C.) in one hour, run several hours, cool to 300° F. (150° C.) in one hour and remove for inspection; reinstall, heat to 1500° F. (approximately 820° C.) in 30 minutes, run several hours, cool to 300° F. (150° C.) in 30 minutes and remove for inspection; reinstall, heat to 1500° F. (approximately 820° C.) in approximately 15 minutes, cool to 300° F. (150° C.) in approximately 15 minutes and repeat through one hundred consecutive identical 30 minute peak to peak cycles. It was found that a lower incidence of cracking occurred in the cement joint areas in wheels fabricated in the above-described fashion than in comparable wheels fabricated with cement joints extending continuously across their annular faces.

Figure 5:
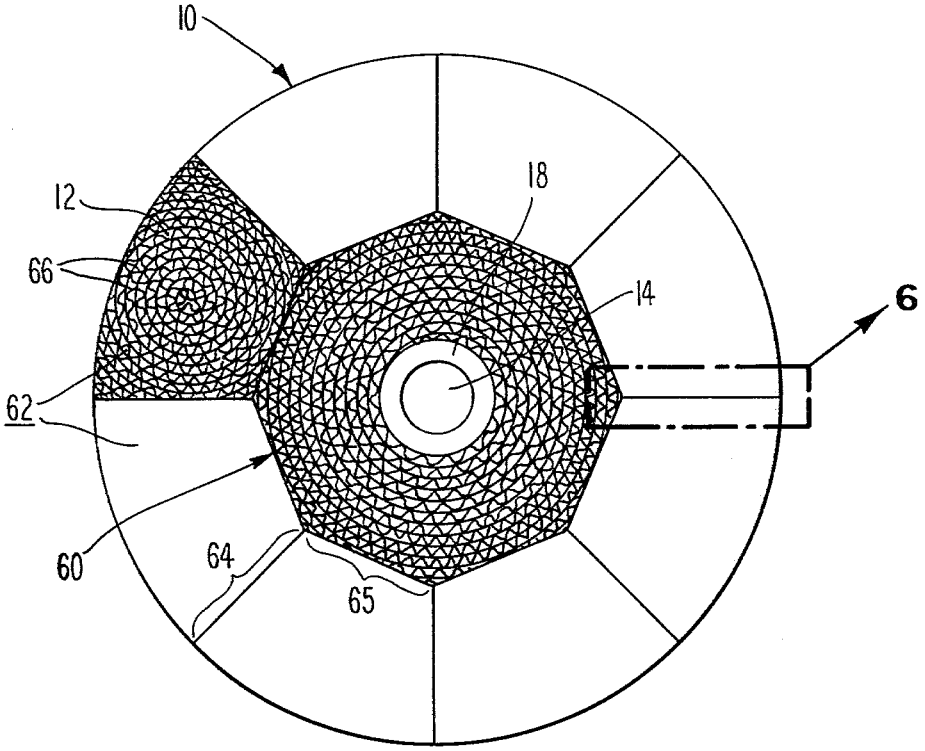
FIG. 5 is a diagrammatic view along line 2—2 of FIG. 1 of a second heat recovery wheel made in accordance with the the teachings of the invention by joining together cellular segments formed by the wrap method.

FIG. 5 depicts diagrammatically a second embodiment of the invention used with the prior wrap-type heat recovery wheel constructed from relatively large cellular segments. A honeycombed octagonal core 60 surrounds a solid cylindrical hub 18. Evenly disposed around the periphery of the octagonal core 60 are eight honeycombed "petals" 62 which are symmetrically sized and shaped and extend to the outer circumference of the wheel 10. Cement joints 64 affix each petal 62 to adjoining petals 62. Similarly cement joints 65 affix each petal 62 to the octagonal core 60.

The octagonal core 60 and petals 62 are formed by the wrap method of overlying layers of thin corrugated webs 66 of sinterable ceramic-based material and firing so as to create a rigid matrix of hollow open-ended cells 12 extending through each petal 62 and the octagonal core 60. The wrap method used in the fabrication of the octagonal core 60 and each petal 62 is well-known in the art and described in U.S. Pat. No. 3,112,184 to Hollenbach and other patents. After forming, each wrapped segment is then cut to size and ground to shape. The cylindrical hub 18 depicted in FIG. 5 is solid and is formed by a suitable method for the material used. After forming, the octagonal core 60 is bored by conventional methods to accept the formed hub 18 which is cemented into place with a solid layer of cement. Heat recovery wheels fabricated in this fashion with continuous cement joints extending entirely across their two annular faces have been manufactured for some time by Corning Glass Works from a glass-ceramic material described in U.S. Pat. No. 3,600,204 having a coefficient of thermal expansion less than $10\times10^{-7}$/°C. over the range 0° to 1000° Centigrade. Compatible glass-ceramic cements made in accordance with U.S. Pat. No. 3,634,111 having a comparably low thermal coefficient of expansion have been used in the forming of these wheels. They include the previously noted cement for the first embodiment and the cement of Example No. 1 in Table II of U.S. Pat. No. 3,634,111.

Figure 6:
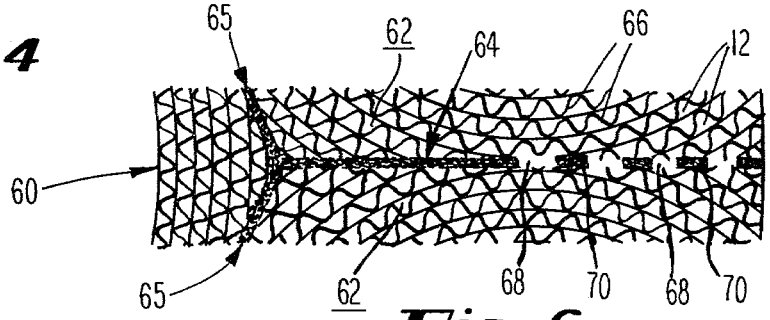
FIG. 6 is a blown-up view of area 6 of the wheel depicted in FIG. 5 showing an individual wrapped cellular segment and the cement joints formed therewith.

Turning now to FIG. 6 which is a blow-up of area 6 of FIG. 5, there is depicted a cement joint 64 and portions of cement joints 65 between petals 62 adjoining one another and the octagonal core 60 respectively. The wheel 10 depicted in FIGS. 5 and 6 has been improved over the prior art wheels by the creation of discontinuities 68 in the cement joints 64 between adjoining petals 62. Discontinuities 68 of even widths, approximately eleven-sixteenths (11/16) of an inch (1.7 cm) measured in the radial direction of the wheel, are created at evenly spaced intervals, also approximately eleven-sixteenths (11/16) of an inch (1.7 cm) on center (final finished dimensions), between the approximate midpoint of the adjoining peripheral side walls of adjoining petals 62 and the outer circumference of the wheel 10. Cement segments 70 remain between the discontinuities 68. Preferably, the discontinuities are created by originally striping the cement between the adjoining peripheral side walls of each petal 62, as has been previously described with respect to the first embodiment of the invention, so as to form straight, parallel walled discontinuities 68 which extend axially through the wheel 10. Again, as the wheel 10 is intended to be operated with hot and cold faces, the cement is not applied out to the resulting hot face of the wheel but is instead preferably terminated approximately ½-inch (1.27 cm) short of that surface in accordance with the invention described in the aforesaid copending companion application Ser. No. 205,776. The remaining portion of the cement joints 64 from the midpoint of the adjoining petals 62 inward to the octagonal hub 60 and the cement joints 65 between the petals 62 and the octagonal hub 60 are solid and continuous and again recessed approximately one-half inch (1.27 cm) from the resulting hot face of the wheel 10. Continuous joints have been provided here to strengthen the wheel because of the greater mechanical stresses resulting from the relatively large size of the petals 62 and because the thermally induced stresses in the joint areas are not as severe as those resulting in the previously described cordierite wheels due to the very low thermal coefficient of expansion of the glass-ceramic cellular segments and foamed cement used. The cement joining the hub 18 to the octagonal core 60 is again not recessed because that area is not directly exposed to the hot and cold gases and so is not subject to the significant axial temperature differences to which the matrix area of the wheel is exposed.

Although the invention has been described with respect to the fabrication of two types of heat recovery wheels, the invention is equally applicable in the fabrication of other honeycombed structures from smaller cellular segments, which structures are intended to allow the passage of hot fluids therethrough.

Although particular dimensions for discontinuities were disclosed for two types of heat recovery wheel it is envisioned that discontinuities of other sizes and spacings can be successfully employed. Moreover, in the examples described, the discontinuities were substantially uniform in size and spacing. This may not be the case, however, in other structures or even other wheels where it may be desirable to provide a greater concentration of discontinuities in particular joints or to vary the width or spacing of the discontinuities or both in a particular area of the structure so as to minimize stresses by providing greater flexibility or reducing axial temperature differences through the joints or to increase strength.

It will also be realized that any method of creating discontinuities which is suitable for working the bond joint material, such as drilling, etching, burning, etc., may be used to practice the invention.

It will be understood that the appended claims are intended all embodiments and modifications which fall within the true spirit and scope of the invention.

We claim:

1. In a method of making a honeycombed structure having a plurality of open-ended, hollow cells which allow the passage of fluids therethrough from a first to a second outer surface thereof, from a plurality of cellular segments each having a pair of opposing honeycombed surfaces formed from a plurality of open-ended, hollow cells extending therethrough and peripheral side walls therearound, comprising the steps of forming said cellular segments and joining a peripheral wall of each of said segments to a peripheral wall of another so as to form a joint therebetween, the improvement comprising the step of:

creating a plurality of discontinuities between said first and second outer surfaces in said joints whereby fluids are allowed to flow through said first and second outer surfaces of said structure through the discontinuities of said joints.

2. The method described in claim 1 wherein the steps of joining and creating are combined in one operation.

3. The method described in claim 2 wherein said cellular segments are joined to one another with cement and the step of creating discontinuities comprises applying the cement discontinuously to said peripheral side walls being joined.

4. The method described in claim 3 wherein the discontinuities are created by applying the cement so as to form even discontinuities of approximately even size along the length of one or more of said joints.

5. The method described in claim 4 wherein the cement is also applied so as to be formed in even lengths between said evenly sized discontinuities.

6. The method described in claim 5 wherein the cement is also applied so as to form essentially parallel, straight stripes separated by said discontinuities.

7. The honeycombed structure produced by the method described in claims 1.

8. A heat recovery wheel produced by the method described in claim 6 and formed from a material comprising a ceramic.

9. The heat recovery wheel described in claim 8 wherein said wheel is formed by a single layer of said cellular segments.

10. A heat recovery wheel having a pair of opposing outer annular faces and a central axis therebetween, comprising:

a plurality of cellular segments adjoining one another, each of said segments having a plurality of interconnected walls forming a plurality open-ended hollow cells extending between a pair of opposing honeycombed surfaces, and further having peripheral side walls as its remaining outer surfaces;

a plurality of joints, each affixing one of said segments to another along said peripheral side walls; and one or more discontinuities extending through one or more of said joints to said outer annular faces.

11. The wheel described in claim 10 wherein said discontinuities comprise essentially straight, parallel walled channels, each having a central longitudinal axis essentially parallel to said central axis of said wheel.

12. The wheel described in claim 11 wherein said discontinuities are provided at evenly spaced intervals along said peripheral side walls of adjoining cellular segments.

13. The wheel described in claim 12 wherein said discontinuities are of even length along said peripheral side walls of said adjoining cellular segments.

14. The wheel described in claim 11 wherein said discontinuities are also of even length along said peripheral side walls of said adjoining cellular segments.

15. The wheel described in claim 10 wherein said discontinuities are present between all of said adjoining peripheral side walls.

16. The wheel described in claim 10 wherein said joints are formed from cement.

17. The wheel described in claim 10 wherein said cellular segments are formed from a material comprising a ceramic.

18. The wheel described in claim 17 wherein said ceramic is a cordierite material containing at least two percent manganese oxide by weight.

19. The wheel of claim 10 wherein said wheel is fabricated from ceramic, glass ceramic, glass, sintered metal, cermet or other ceramic based materials.

* * * * *